US005694670A

United States Patent [19]

Hosseinian et al.

[11] Patent Number: 5,694,670

[45] Date of Patent: Dec. 9, 1997

[54] SECURE SWAGING TOOL

[76] Inventors: Amir P. Hosseinian, 15461 Camarillo, Sherman Oaks, Calif. 91403; John L. Binford, 150 N. Woodlake Dr., Lake Elsinore, Calif. 92530

[21] Appl. No.: 452,269

[22] Filed: May 26, 1995

[51] Int. Cl.[6] ..... B21D 39/04

[52] U.S. Cl. ..... 29/237; 72/453.15

[58] Field of Search ..... 72/416, 412, 453.16, 72/453.15, 453.02; 29/237, 252, 234, 282

[56] References Cited

U.S. PATENT DOCUMENTS

| | | | |
|---|---|---|---|
| 539,573 | 5/1895 | Cartwright . | |
| 1,018,035 | 2/1912 | De Leeuw . | |
| 1,085,461 | 1/1914 | Michaelis . | |
| 1,186,813 | 6/1916 | McFerran . | |
| 1,350,904 | 8/1920 | Walters . | |
| 2,310,744 | 2/1943 | Osborn | 285/97.3 |
| 2,328,747 | 9/1943 | Schweidler | 7/14.1 |
| 2,333,120 | 11/1943 | Parker | 29/237 |
| 2,613,959 | 10/1952 | Richardson | 285/122 |
| 2,623,080 | 12/1952 | Young | 13/16 |
| 2,695,539 | 11/1954 | Grueninger | 81/17.2 |
| 3,143,790 | 8/1964 | Over et al. | 29/203 |
| 3,280,864 | 10/1966 | Spanenberg . | |
| 3,299,496 | 1/1967 | Christensen | 29/237 |
| 3,451,697 | 6/1969 | Bula | 285/93 |
| 3,474,519 | 10/1969 | Hallesy | 29/432 |
| 3,498,648 | 3/1970 | Hallesy | 285/343 |
| 3,579,794 | 5/1971 | Powell | 29/237 |
| 3,585,704 | 6/1971 | Schroeder | 29/275 |
| 3,599,310 | 8/1971 | Brownlee | 29/237 |
| 3,700,227 | 10/1972 | Sessody | 269/24 |
| 3,726,122 | 4/1973 | Dawson | 29/237 |
| 3,727,289 | 4/1973 | Bemelmann et al. | 29/237 |

(List continued on next page.)

FOREIGN PATENT DOCUMENTS

| | | | |
|---|---|---|---|
| 1146247 | 3/1963 | Germany | 29/237 |
| 2032444 | 1/1972 | Germany . | |
| 3039818 | 5/1982 | Germany . | |
| 28769 | 8/1932 | Netherlands . | |

OTHER PUBLICATIONS

*Deutsch Permalite Series,* Aug. 1992, Permalite Composite–Assist Tube Connections, 4 pages.

*Rynglok* Bulletin 1674, 1987, Aeroquip, 8 pages.

*The Lokring Pipe and Tube Joining System,* Lokring Corporation, 2 pages.

*Primary Examiner*—Daniel C. Crane

*Attorney, Agent, or Firm*—Sheldon & Mak; Denton L. Anderson

[57] ABSTRACT

A secure swaging tool 10 for compressing an axially swaged fitting 12 having a sleeve 28 and a collar 32 onto a tube 14 includes (i) a housing 16 defining a partially enclosed chamber 40; (ii) a movable element 18, i.e., a piston, disposed within the chamber 40 and movable between a retracted position 102 and an extended position 104; (iii) a housing jaw 20 attached to the housing 16; (iv) a movable jaw 22 affixed to the movable element 18, movement of the movable element 18 from the retracted position 102 to the extended position 104 causes the movable jaw 22 to approach the housing jaw 20 along a fixed axis; and (v) first and second swaging adapters 24, 26, one swaging adapter is disposed in each jaw. The first swaging adapter 24 retains the sleeve 28 while the second swaging adapter 26 retains the collar 32 which induces a radial swaging force to the sleeve 28 when the movable element 18 is moved from the retracted position 102 towards the extended position 104. At least one of the swaging adapters 24, 26 is a locking swaging adapter which substantially encircles a portion of the axially swaged fitting so that the swaging tool 10 does not disengage from the swage fitting 12 during swaging. Further, at least one of the swaging adapters 24, 26 can be removably attached to one of the jaws 20, 22 so that a different swaging adapter can be used for different types, styles or sizes of swage fittings. Optimumly, the housing jaw and the movable jaw 22 each alternately and removably accept and restrain both swaging adapters 24, 26 so that both swaging adapters 24, 26 can be disposed in either jaw so that the orientation of the swaging tool 10 can be rotated to be used in confined areas.

9 Claims, 2 Drawing Sheets

U.S. PATENT DOCUMENTS

| | | | |
|---|---|---|---|
| 3,777,354 | 12/1973 | Masters | 29/237 |
| 4,061,367 | 12/1977 | Moebius | 285/382.2 |
| 4,103,937 | 8/1978 | Wakefield | 285/110 |
| 4,170,125 | 10/1979 | Minka | 72/410 |
| 4,189,817 | 2/1980 | Moebius | 29/237 |
| 4,257,135 | 3/1981 | Moebius | 7/125 |
| 4,345,361 | 8/1982 | Baumann | 29/237 |
| 4,483,056 | 11/1984 | Schwalm et al. | 29/237 |
| 4,559,691 | 12/1985 | Mannhart et al. | 29/283.5 |
| 4,793,167 | 12/1988 | Beiley et al. | 72/19 |
| 4,809,418 | 3/1989 | Bürii | 29/237 |
| 4,844,516 | 7/1989 | Baker | 285/351 |
| 5,005,877 | 4/1991 | Hayman | 285/315 |
| 5,297,325 | 3/1994 | Thelen | 29/237 |
| 5,303,958 | 4/1994 | Hyatt et al. | 285/23 |
| 5,305,510 | 4/1994 | Croft | 29/252 |
| 5,347,701 | 9/1994 | Hosseinian et al. | 29/508 |
| 5,398,494 | 3/1995 | Hyatt et al. | 29/237 |

SECURE SWAGING TOOL

BACKGROUND

The present invention is directed to a secure swaging tool for compressing a swage fitting onto an end of a tube.

Swage fittings are commonly used in aircraft, marine, petroleum and chemical industries for connecting ends of tubes together in fluid tight relationship. These swage fittings typically utilize a cylindrical shaped sleeve having an opening at opposite ends for receiving the two tube ends. Typically, a swaging tool is used to radially compress and deform the sleeve around each tube to create a fluid-tight connection between the sleeve and each tube.

Two types of swage fittings are commonly used. The first type utilizes the swaging tool to deform and directly compress the sleeve against the tube, while the second type utilizes a cylindrical collar, axially moved over the sleeve by the swaging tool to compress the sleeve to the tube. The first type of swage fitting shall be referred to as a radially swaged fitting while the second type of swage fitting shall be referred to as an axially swaged fitting. This Application is directed to a swaging tool for the second type of swage fitting.

Presently, existing swaging tools for axially swaged fittings utilize (i) a piston moveable in a housing from a retracted position to an extended position, (ii) a first swaging adapter affixed to the housing for holding the sleeve and (iii) a second swaging adapter affixed to the piston for inducing the radial compressive force on the sleeve when the piston is moved towards the extended position. For axially swaged fittings, the second swaging adapter is sized and shaped to retain the collar so that the collar moves axially over the sleeve when the piston moves towards the extended position.

However, the existing hydraulic swaging tools for axially swaged fittings have proved to be inadequate since the swaging adapters are designed to only grip a portion of the swage fitting. Since a significant amount of force may be required to axially move the collar over the sleeve to axially swage the fitting, one or both of the swaging adapters may deflect and deform, causing the swaging tool to disengage from the swage fitting and potentially cause injury to the user.

Accordingly, there is a need for a swaging tool which is secured to the axially swaged fitting to ensure that the swaging tool does not disengage from the swage fitting during the swaging.

SUMMARY

The present invention is directed to a swaging tool that satisfies this need. A swaging tool for axially swaged fittings according to the present invention includes at least one locking swaging adapter which encircles a portion of an axially swaged fittings to ensure that the swaging tool does not disengage from the axially swaged fitting during swaging. Thus, there is less risk of injury to the user of the swaging tool.

Accordingly, the invention is a tool for swaging an axially swaged fitting having a sleeve and collar comprising (i) a housing defining a partially enclosed chamber having a longitudinal axis; (ii) a movable element, typically a piston, disposed within the chamber and axially movable in the chamber along the longitudinal axis between a retracted position and an extended position; (iii) a housing jaw affixed to the housing; and (iv) a movable jaw affixed to the movable element. Movement of the movable element from the retracted position towards the extended position causes the movable jaw to approach the housing jaw along a fixed axis which is offset from the longitudinal axis of the chamber.

The sleeve and the collar of the axially swaged fitting each include contact surfaces. The housing jaw accepts one of the contact surfaces and restrains that contact surface from axial movement away from the other contact surface and the movable jaw accepts the other contact surfaces and restrains that contact surface from axial movement away from the housing jaw. At least one of the jaws substantially encircles a portion of the axially swaged fitting. Thus, the locking swaging adapter prevents the swaging tool from disengaging from the swage fitting, thereby averting the potential of injury to the user.

The collar is sized and shaped so when the collar is axially moved over the sleeve, it radially compresses of the sleeve. Thus, when the movable element moves towards the extended position, the collar is axially moved over the sleeve and the collar radially compresses the sleeve.

The housing and movable jaws can include (i) a first swaging adapter that accepts the contact surface of the sleeve and restrains the sleeve from axial movement away from the collar, (ii) a second swaging adapter that accepts the contact surface of the collar and restrains the collar from axial movement away from the sleeve, and (iii) at least one of the swaging adapters is a locking swaging adapter which substantially encircles at least a portion of the fitting. One of the swaging adapters is disposed in the housing jaw, while the other swaging adapter is disposed in the movable jaw.

At least one of the swaging adapters, and more preferably both of the swaging adapters can be removable and interchangeable with other swaging adapters to allow the swaging adapters to be changed to suit the specific type, style, and size of swage fitting being used. Accordingly, the same swaging tool can be used for a number of different types, styles and sizes of fittings. Further, the removable swaging adapters can be replaced when damaged, instead of replacing the entire swaging tool.

Optimumly, the housing jaw and the movable jaw each alternately and removably accept and restrain both)the first and second swaging adapters so that the first and second swaging adapters can be placed in either the housing jaw or the movable jaw. This feature allows for uniformity in the design of the swaging adapters and allows the orientation of the swaging tool to be rotated so that the tool can be effectively operated in a confined area.

This feature can be accomplished by having the first and second swaging adapters each have a similarly shaped and sized outer surface and the housing and movable jaws each have an adapter opening sized and shaped to alternately accept and restrain the outer surface of either swaging adapter. For example, the outer surface of each swaging adapter can include opposed, substantially parallel sides and each adapter opening can include opposed, substantially parallel walls, spaced apart to accept the sides of the swaging adapters.

Each locking swaging adapter can include an upper and lower section having opposed, substantially parallel sides, and each jaw can include an adapter opening having opposed, substantially parallel walls spaced apart to accept the sides of the upper and lower sections. Thus, the sides of the upper and lower sections fit into each adapter opening.

Further, to retain the lower section in the swaging adapter opening, each wall of each adapter opening includes a vertical inset and each side of each lower section includes a vertical groove which accepts the inset and restrains the lower section from axial movement. Alternately, the vertical inset is on each side of the lower section and the vertical groove is in the walls of the adapter opening.

The upper section of the locking adapters includes a hinged corner hingedly connected to one of the jaws and an opposed releasable corner which pivots about the hinged corner to allow the swage fitting into the locking swaging adapter. The jaw can include a selectively activated latch which when activated secures the releasable corner to the jaw so that the axially swaged fitting is retained between the upper and lower sections. Alternately, the hinged corner can be hingedly connected to the lower section and the lower section can include the latch for selectively retaining the releasable corner.

During swaging, depending upon the type, style and size of swage fitting utilized, a significant amount of force may be required to swage a particular swage fitting. Thus, the movable jaw and housing jaw may be subjected to a significant amount of force which may cause the deflection and/or deformation of the movable jaw.

To prevent deflection of the movable jaw during swaging, an outer surface of the housing can include at least one lip, and for additional support, two lips, which extend substantially parallel to a longitudinal axis of the chamber. For each lip, the movable jaw includes a catch in sliding engagement with that lip. The sliding engagement between the lip and the catch inhibits the deflection of the movable jaw during swaging and keeps the movable jaw aligned along the fixed axis with the housing jaw and allows for the smooth movement of the movable element in the chamber.

For additional support against deflection of the movable jaw, the movable jaw can include at least one transfer arm, and more preferably two transfer arms extending away from a rearward face of the movable jaw. Each transfer arm includes a bottom surface in sliding engagement with the housing. The sliding contact between the bottom surface and the housing also inhibits the deflection of the movable jaw during swaging, keeps the movable jaw aligned along the fixed axis with the housing jaw, and allows for the smooth movement of the movable element in the chamber.

The present invention provides a swaging tool for axially swaged fitting which provides for at least one locking swaging adapter which encircles a portion of the axially swaged fittings to ensure that the swaging tool does not disengage from the axially swaged fitting during swaging, thereby causing injury to the user of the swaging tool. Further, the swaging tool can have removable and interchangeable swaging adapters so that the same swaging tool can be used for the different types, styles and/or sizes of swage fittings.

DRAWINGS

These and other features, aspects and advantages of the present invention will become better understood with reference to the following description, appended claims and accompanying drawings where:

DESCRIPTION

Figures 1, 4:
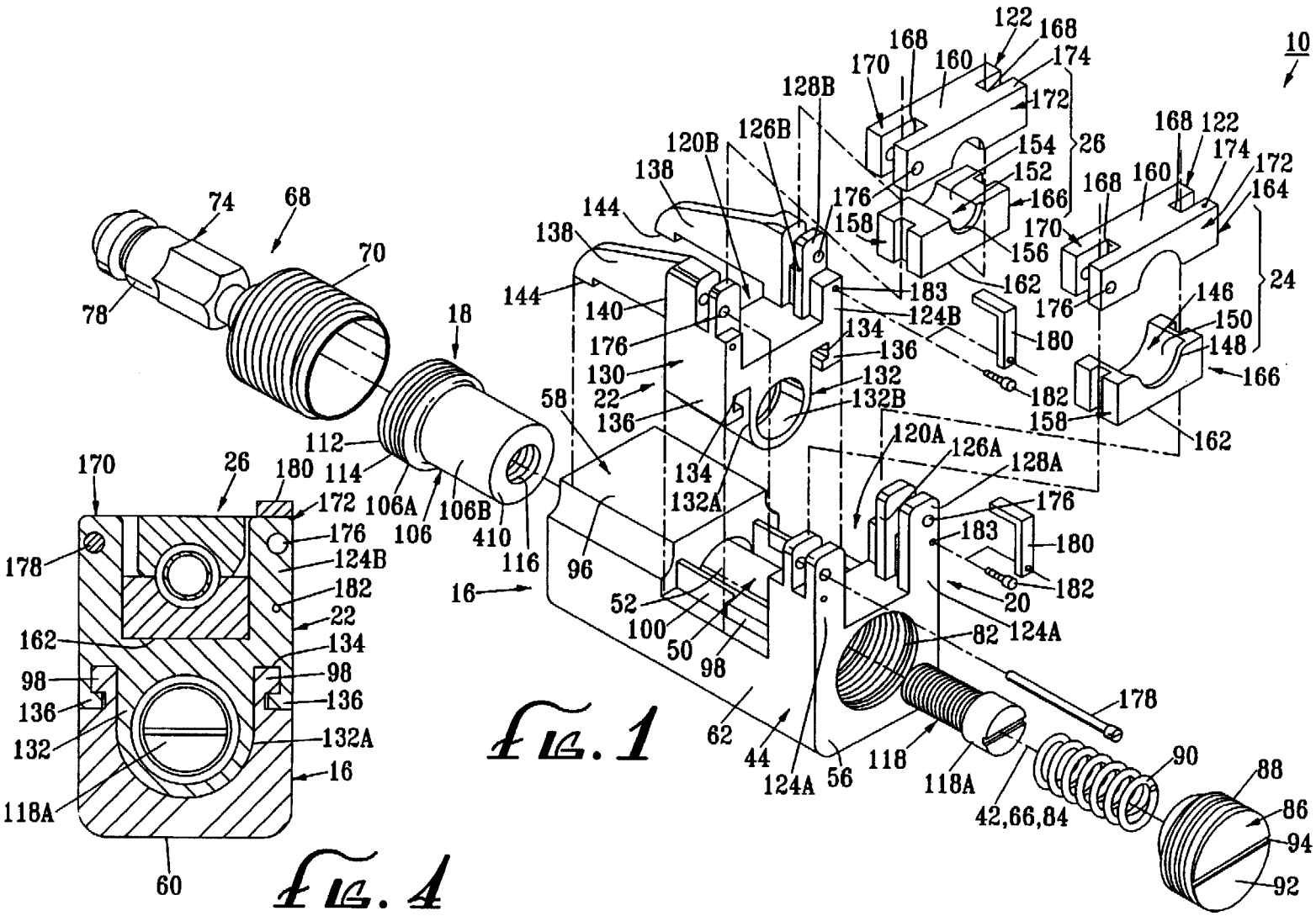
FIG. 1 is an exploded perspective view of a swaging tool having features of the present invention.
FIG. 4 is a cut-away view taken from lines 4—4 of FIG. 3.

With reference to the figures, the present invention is directed to a swaging tool 10 for connecting a swage fitting 12 to a tube 14. The swaging tool 10 comprises (i) a housing 16, (ii) a movable element 18, (iii) a housing jaw 20, (iv) a movable jaw 22, and (v) first and second swaging adapters 24, 26.

The following discussion describes in detail one embodiment of the invention and several variations on that embodiment. This discussion should not be construed as limiting the invention to that particular embodiment or to those particular variations. Practioners skilled in the art will recognize numerous other embodiments and variations as well. For a definition of a complete scope of the invention, the reader is directed to the appended claims.

As previously mentioned, two types of swage fittings 12 are commonly used. Both types of swage fitting 12 utilize a hollow, tubular shaped sleeve 28 which receives the tube 14. The first type utilizes the swaging tool 10 to deform and directly compress an exterior surface 30 of the sleeve 28 against the tube 14, while the second type utilizes a cylindrical collar 32, axially moved over the sleeve 28 by the swaging tool 10 to compress the sleeve 28 to the tube 14. The first type of swage fitting 12 is being referred to as a radially swaged fitting, while the second type of swage fitting 12 is referred to as an axially swaged fitting.

The swage fitting 12 shown in the figures is an axially swaged fitting and the tubular sleeve 28 has opposed sleeve ends 34*a*, 34*b* which each receive an end of the tube 14. Alternately, one of the opposed sleeve ends 34*a*, 34*b* can include an externally threaded or an internally threaded surface (not shown) and/or the swage fitting 12 could be a tee, an elbow or some other shaped fitting.

The length and shape of the swage fitting 12 varies according to the specific application, the size of the tubes 14 being connected, the required pressure rating of connection, and the preferences of the manufacturer. For example, the manufacturer determines the size and shape of the (i) sleeve 28, (ii) the collar 32, (iii) a contact surface 36 of the sleeve 28, and (iv) a contact surface 38 of the collar 32. In the embodiment shown in the drawings, the contact surface 36 of the sleeve 28 is an annular groove in the sleeve 28 and the contact surface 38 of the collar 32 is an end of the tubular collar 32 which is annular ring shaped.

The swage fitting 12 shown in the figures is similar to the swage fitting 12 disclosed in U.S. Pat. No. 5,347,701, Hosseinian et al., issued Sep. 20, 1994, which is incorporated herein by reference.

The housing 16 provides the structure of the swaging tool 10 and the movable element 18, the housing jaw 20, and the movable jaw 22 are either fixedly or slidingly connected to the housing 16. The housing 16 is constructed of a suitable material such as steel and includes (i) a partly enclosed chamber 40 having a longitudinal axis 42, and (ii) an outer housing surface 44.

The design of the chamber 40 varies according to the design of the movable element 18. In the embodiment shown in the figures, the chamber 40 is substantially right, cylindrical shaped and includes a front cavity 46, an intermediate cavity 48 and a rear cavity 50. The front cavity 46 guides and slidingly seals the movable element 18, the intermediate cavity 48 guides the movable element 18 and the rear cavity 50 guides the movable jaw 22. To correspond with the shape of the movable element 18, the cross-sectional diameter of the front cavity 46 is larger than the cross-sectional diameter of the intermediate cavity 48. The rear cavity 50 includes a rectangular shaped opening 52 extending through the housing 16 for receiving the movable jaw 22.

The design of outer housing surface 44 can vary. For example, in the embodiment shown in the drawings, the outer housing surface 44 is substantially rectangular having an inlet end 54, an opposed return end 56, a housing top 58, a housing bottom 60, and opposed housing sides 62. Alternatively, the outer housing surface 44 can be substantially right cylindrical shaped.

To permit assembly of the swaging tool 10, the inlet end 54 includes an internally threaded surface 64 extending from the inlet end 54 into the chamber 40, the internally threaded surface 64 having a longitudinal axis 66 corresponding with the longitudinal axis 42 of the chamber 40. A front cap 68 is threaded into the internally threaded surface 64 of the inlet end 54. The front cap 68 has (i) a hollow, tubular shaped body 70 with an externally threaded surface that mates with and is threaded into the internally threaded surface 64 of the inlet end 54 of the housing 16, and an interior surface which forms the front cavity 46 of the chamber 40, (ii) a front side 72 which substantially encloses one end of the tubular shaped body 70, (iii) an inlet valve 74 extending transversely from the front side 72 away from the housing 16 and (iv) an inlet opening 76 extending through the front side 72 and allowing the inlet valve 74 and the front cavity 46 to be in fluid communication.

The inlet valve 74 includes a quick connect coupling 78 which allows for connection to a pressurized pneumatic or hydraulic supply (not shown). Further, the inlet valve 74 can include a hexagonal wrench surface 80 for assembly of the front cap 68 into the housing 16.

The return end 56 of the housing 16 includes an internally threaded surface 82 extending from the return end 56 into the rear cavity 50 of the chamber 40, the internally threaded surface 82 having a longitudinal axis 84 corresponding with the longitudinal axis 42 of the chamber 40. An end cap 86 is threaded into the internally threaded surface 82 of the return end. The end cap 86 has (i) a hollow, tubular shaped body 88 with an externally threaded surface that mates with and is threaded into the internally threaded surface 82 of return end of the housing 16, and an interior surface which receives a compression spring 90, (ii) a rear side 92 which substantially encloses one end of the tubular shaped body, and (iii) a slot 94 in the rear side 92 for receiving a screwdriver (not shown) for assembly of the end cap 86 into the housing 16.

The housing top 58 includes (i) a substantially flat surface 96 which can extend from the inlet end 54 over the front and intermediate cavities 46, 48, and (ii) the rectangular opening 52 which extends through the housing top 58 into the rear cavity 50 for the movable jaw 22. A horizontal lip 98 extends transversely from each opposed housing side 62, along the rectangular opening 52 and substantially parallel with the longitudinal axis 42 of the chamber 40. A slot 100 is provided in each lip 98 to allow for assembly of the movable jaw 22 to the housing 16.

The movable element 18 is disposed within the chamber 40 and is capable of axial movement along the longitudinal axis 42 of the chamber 40 between a retracted position 102 and an extended position 104. In the embodiment shown in the figures, the movable element 18 is a right cylindrical shaped piston having (i) a piston side surface 106, (ii) a piston face 108, and (iii) piston back 110.

The piston side surface 106 shown in the figures includes a forward portion **106*a* which is in axial sliding engagement with the front cavity 46 of the chamber 40 and a rearward portion 106*b* which is in axial sliding engagement with the intermediate cavity 48 of the chamber 40. In the embodiment shown in the figures, the forward portion 106*a* has a larger cross-sectional diameter than the rearward portion 106*b*. Further, the forward portion 106*a* includes two annular grooves 112, each annular groove 112 for receiving an O-ring 114 or other type of seal for slidingly sealing the forward portion 106*a* of the piston to the front cavity 46**.

Figure 2:
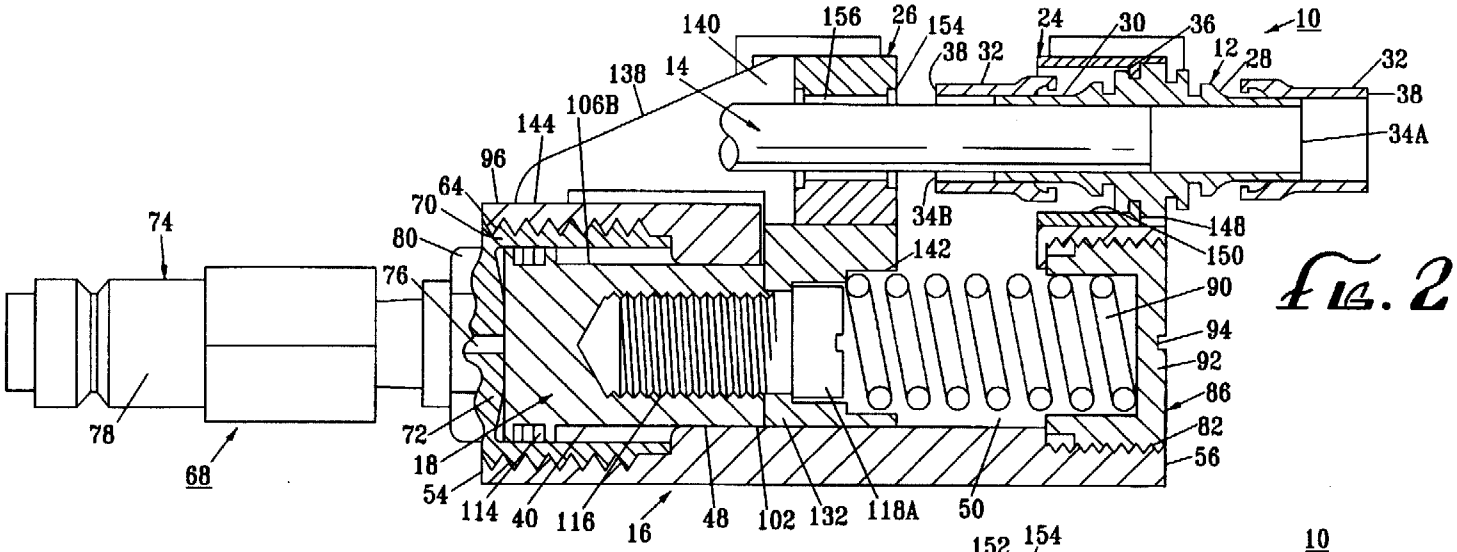
FIG. 2 is a side sectional view of an axial swaged fitting in the tool of FIG. 1 showing the movable element in the retracted position.
Figure 3:
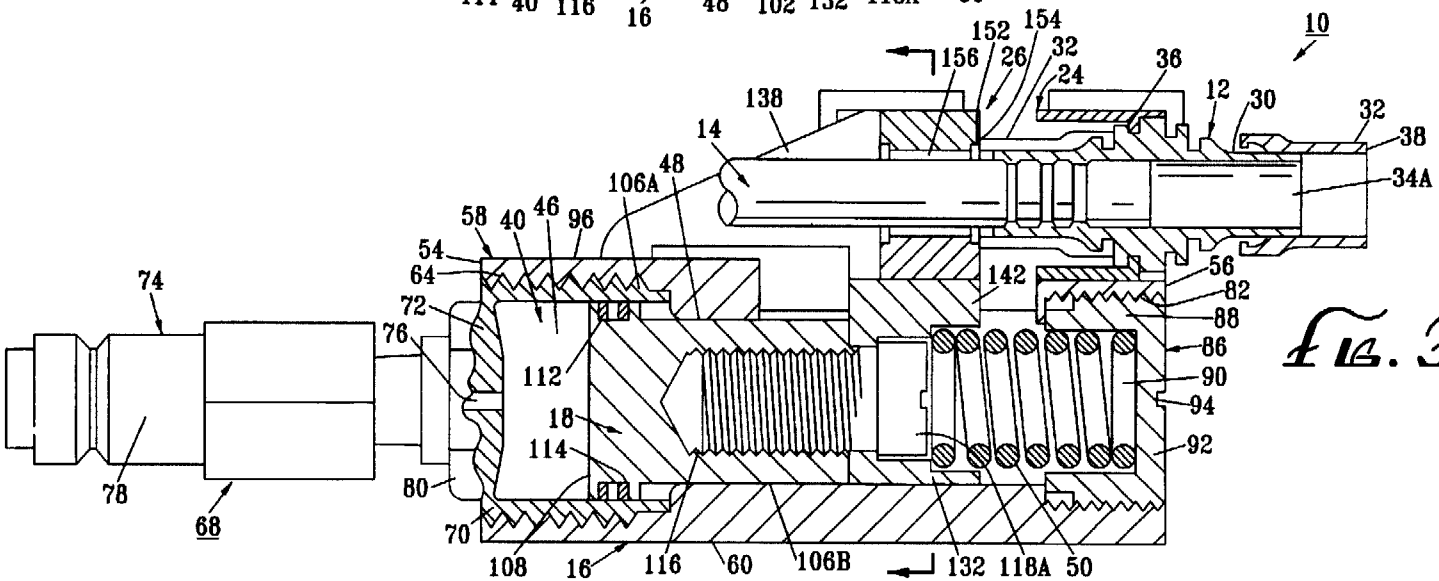
FIG. 3 is a side section view of the axial swage fitting and swaging tool of FIG. 2 showing the movable element in the extended position.

With reference to FIGS. 2 and 3, the piston is moved from the retracted position 102 to the extended position 104 when a sufficient amount of pressurized hydraulic or pneumatic supply is released through the inlet valve 74 against the piston face 108.

The piston back 110 includes an internally threaded surface 116 for receiving a bolt 118 for attaching the movable jaw 22 to the piston. Alternatively, the movable element 18 and movable jaw 22 can be attached in a number of different ways. For example, an externally threaded member (not shown) could extend from the piston back 110 and a mating nut (not shown) could be used to attach the piston to the movable jaw 22.

The compression spring 90 is placed between movable jaw 22 and the end cap 86 to return the piston from the extended position 104 to the retracted position 102. With reference to FIGS. 2 and 3, the compression spring 90 is compressed when the pressurized supply moves the piston from the retracted position 102 towards the extended position 104. When the pressurized supply is removed, the compression spring 90 returns the piston to the retracted position 102.

Alternatively, the movable element 18 can be some other device capable of axial movement along the longitudinal axis 42 of the chamber between the retracted position 102 and the extended position 104. For example, the movable element 18 can be a body (not shown) having an internally threaded surface which is moved between the retracted position 102 and the extended position 104 by the rotation of an externally threaded surface.

The housing jaw 20 extends upwardly from and is secured to the housing top 58 proximate the return end 56. In the embodiment shown in drawings, for structural integrity, the housing jaw 20 is manufactured as a part of the housing 16. Alternatively, the housing jaw 20 could be a separate piece secured to the housing 16.

The housing jaw 20 accepts and restrains either the first or second swaging adapters 24, 26. Preferably, the housing jaw 20 includes an adapter opening **120*a* for alternately receiving and restraining the first swaging adapter 24 and the second swaging adapter 26 so that the swaging adapters 24, 26 can be interchanged with swaging adapters 24, 26 which fit other types, styles and/or sizes of swage fittings 12 and the orientation of the swaging tool 10 can be reversed. Thus, the size and shape of the housing jaw 20 varies according to the size and shape of the first and second swaging adapters 24, 26**.

In the embodiment shown in the drawings, the swaging adapters 24, 26 include an outer surface 122 which is substantially rectangular. Thus, the adapter opening **120*a* in the housing jaw 20 is substantially rectangular and the housing jaw 20 includes two walls 124*a* extending substantially vertically above the housing top 58, spaced apart to receive either of the swaging adapters 24, 26. At least one vertical inset 126*a*** extending transversely from each wall 124a can be used for restraining the swaging adapters 24, 26 from axial movement. Further, a pair of substantially parallel flanges 128a can extend vertically from each of the walls 124a for retaining the swaging adapters 24, 26 in the housing jaw 20.

Alternatively, if the outer surface 122 of the swaging adapters 24, 26 is a different shape, i.e., cylindrical, the adapter opening 120a would be designed to removably accept the cylindrical shaped swaging adapters 24, 26 in the housing jaw 20.

The movable jaw 22 is affixed to and moves with the movable element 18. Further, the movable jaw 22 is aligned with the housing jaw 20 so that movement of the movable element 18 from the retracted position 102 towards the extended position 104 causes the movable jaw 22 to approach the housing jaw 20 on a fixed axis which is offset from the longitudinal axis 42 of the chamber.

The movable jaw 22 accepts and restrains either the first or second swaging adapters 24, 26. Preferably, the movable jaw 22 also includes an adapter opening 120b for alternately receiving the first swaging adapter 24 and the second swaging adapter 26 so that the swaging adapters 24, 26 can be interchanged with swaging adapters 24, 26 which fit other types, styles and/or sizes of swage fittings 12 and the orientation of the swaging tool 10 can be reversed.

The movable jaw 22 comprises (i) a jaw body 130 having a squared "U" shaped cross-section with substantially parallel walls 124b extending vertically to define the adapter opening 120b in the moveable jaw 22, (ii) a hollow, tubular shaped retainer 132 affixed to a bottom 134 of the jaw body 130, (iii) a pair of opposed catches 136 extending from the bottom 134 of the jaw body 130, each catch 136 being on opposite sides of the retainer 132 for sliding engagement with the lips 98, and (iv) a pair of transfer arms 138, each transfer arm 138 extending from a rearward surface 140 of the jaw body 130.

At least one vertical inset 126b extending transversely from each wall 124b can be used for restraining the swaging adapters 24, 26 from axial movement. Further, a pair of substantially parallel flanges 128b can extend vertically from each of the walls 124b for retaining the swaging adapters 24, 26 in the moveable jaw 22.

Alternately, if the outer surface 22 of the swaging adapters 24, 26 is a different shape, i.e. cylindrical, the adaptor opening 120b in the moveable jaw 22 could be designed to removably accept the cylindrically shaped swaging adapters 24, 26.

The tubular shaped retainer 132 is secured to the bottom 134 of the jaw body 130. The retainer 132 has an outer surface 132a which is in sliding engagement with the rear cavity 50 and an inner surface 132b which receives the bolt 118 and is retained by the head 118a of the bolt. The retainer 132 also includes a recessed area 142 for receiving and retaining the compression spring 90.

The catches 136 have an "L" shaped cross-section and extend downwardly from the bottom surface 134 of the jaw body on opposite sides of the retainer 132. To prevent deflection of the movable jaw 22 during swaging, the catches 136 cooperate in sliding engagement with the lips 98 to inhibit deflection of the movable jaw 22 during swaging and keep the movable jaw 22 aligned along the fixed axis with the housing jaw.

The transfer arms extend away from the rearward surface 140 of the walls 124b of the jaw body 130. The transfer arms 138 have a bottom surface 144 which contacts the flat surface 96 of the housing 16 in sliding engagement. The sliding engagement between the bottom surface 144 of the transfer arms and the flat surface 96 of the housing 16 cooperating to inhibit the deflection of the movable jaw 22 during swaging and keep the movable jaw 22 aligned along the fixed axis with the housing jaw.

The first swaging adapter 24 includes a first gripping surface 146 which retains the contact surface 36 of the sleeve 28 and prevents the axial movement of the sleeve 28 away from the second swaging adapter 26. Thus, the design of the first gripping surface 146 varies according to the design of the contact surface 36 of the sleeve 28. In the embodiment shown in the drawings, the contact surface 36 of the sleeve 28 is an annular groove. Accordingly, the first gripping surface 146 includes a protruding lip 148 having a semi-circular cross-sectional opening, which fits into the annular groove. The first gripping surface 146 can also include an enclosing surface 150 having a semi-circular cross-sectional opening which partly encircles the sleeve 28. Alternatively, if the first swaging adapter 24 is a locking swaging adapter, the protruding lip 148 has a circular cross-sectional opening and the enclosing surface 150 has a circular cross-sectional opening for encircling the sleeve 28.

The second swaging adapter 26 includes a second gripping surface 152 which induces the radial compressive force on the sleeve 28 when the movable element 18 is moved from the retracted position 102 towards the extended position 104. For radially swaged fittings, the second gripping surface 152 directly compresses the sleeve 28 against the tube 14. This can be accomplished by having the second swaging adapter 26 include a tapered interior surface (not shown) which radially compresses the sleeve 28 when the second swaging adapter 26 is moved over the sleeve 28. Alternatively, with axially swaged fittings, the cylindrical collar 32 compresses the sleeve 28 against the tube 14. Thus, the second swaging adapter 26 retains the collar 32 so that the collar 32 moves axially over the sleeve 28 when the movable element 18 moves toward the extended position 104. Accordingly, the design of the second gripping surface 152 varies according to the design of the contact surface 38 of the collar 32.

In the embodiment in the drawings, the contact surface 38 of the collar 32 is annular ring shaped. Thus, the second gripping surface 152 includes a semi-circular cross-sectional clearance ring 154 which partly encircles the tube 14 and an impact side surface 156 which abuts against the contact surface 38 of the collar 32. Alternately, if the second swaging adapter 26 is a locking swaging adapter, the clearance ring 154 has a circular cross-section and encircles the tube.

In the embodiment shown in the figures, the contact surface 36 of the sleeve 28 and the contact surface 38 of the collar 32 are not equivalently sized or shaped. Accordingly, the first gripping surfaces 146 cannot be used to retain the contact surface 38 of the collar 32 and the second gripping surface 152 cannot be used to retain the contact surface 36 of the sleeve 28. However, if the contact surfaces 36, 38 are equivalently sized and shaped, the first and second gripping surfaces 146, 152 can be equivalently sized and shaped.

As mentioned previously, one of the swaging adapters 24, 26 is disposed in each of the jaws 20, 22. Preferably, one of the swaging adapters 24, 26 and more preferably both of the swaging adapters 24, 26 are removable from the jaws 20, 22 and replaceable with other swaging adapters 24, 26 to allow the swaging adapters 24, 26 to be interchanged to suit the specific type, style and size of swage fitting 12 being used. Further, it is preferable that the housing 16 and the movable jaw 22 alternately accept both swaging adapters 24, 26 so that the orientation of the swaging tool 10 can be rotated.

In the embodiment shown in the figures, the outer surface 122 of the swaging adapters 24, 26 is sized to fit into the adapter opening 120*a*, 120*b* in either the housing jaw 20 or movable jaw 22 so that either swaging adapter can alternately be affixed to either jaw 20, 22. One or both of the swaging adapters 24, 26 can be locking adapters, which substantially encircle the swage fittings 12 so that the swaging tool 10 does not slip from the swage fitting 12.

Each of the outer surfaces 122 of the swaging adapters 24, 26 shown in the Figures is substantially rectangular and includes opposed, substantially parallel sides 158, a top 160 and an opposed bottom 162. However, the shape and size of the outer surfaces 122 can vary. The swaging adapters 24, 26 shown in the Figures each include an upper section 164 and a lower section 166. Alternatively, if the swaging adapters 24, 26 are not a locking adapter, only the lower section 166 will be necessary to retain the contract surface of the sleeve 28 and/or the collar 32 from axial movement. At least the lower section 166 and preferably the upper section 164 include at least one vertical groove 168 for receiving the vertical inset 126 of the jaws 20, 22.

In the embodiment shown in the figures, the upper section 164 includes a hinged corner 170 hingedly connected to one of the jaws and an opposed releasable corner 172 which pivots about the hinged corner 170 to allow the swage fitting 12 into the swaging adapter 24, 26. In the embodiment shown in include a pair of laterally extending projections 174 which can be inserted between the flanges 128*a*, 128*b* of the walls. An aperture 176 extends transversely through the flanges 128*a*, 128*b* and the projections 174 on the hinged corner 170 and a bolt 178 is disposed in the aperture 176 to facilitate the rotation of the hinged corner 170. Alternatively, the hinged corner 170 can be implemented in a number of different ways. For example, the upper section 164 could be hingedly connected to the lower section 166.

The jaws 20, 22 can include a selectively activated latch 180, which, when activated, secures the detachable corner 172 of the upper section so that the swage fitting 12 is retained between the upper and lower sections 164, 166. In the embodiment shown in the drawings, the latch 180 has an inverted L-shaped cross-section and is attached with a latch bolt 182 which is threaded into an internally threaded latch bolt opening 183 in the jaws 20, 22. The latch 180 pivots on the respective jaw to reach above the upper section 164 to prevent the releasable corner 172 from lifting away from the jaw. Alternatively, the releasable corner 172 can be retained in a number of different ways. For example, the latch 180 could be attached directly to the lower section 166.

In operation, for axially swaged fittings, the tube 14 is placed in the sleeve 28 and the sleeve 28 is disposed in the swaging tool 10 with the movable element 18 in the retracted position 102. The contact surface 36 of the sleeve 28 is retained by the first swaging element 24 and the contact surface 38 of the collar 32 is retained by the second swaging element 26. The movable element 18 is then moved from the retracted position 102 towards the extended position 104. The movement of the movable element 18 and the movable jaw 22 causes the collar 32 to be moved over the sleeve 28. During this movement, the collar 32 radially compresses the sleeve 28 against the tube 14, thereby compressing the swage fitting 12. After the swage fitting 12 is compressed, the movable element 18 is then returned to the retracted position 102.

The first and second swaging adapters 24, 26 are removable from the jaws 20, 22 and can be replaced with other swaging adapters 24, 26, so that the same swaging tool 10 can be used for the different types, styles and/or sizes of swage fittings 12. Preferably, the first and second swaging adapters 24, 26 can be interchanged so that the orientation of the swaging tool 10 can be rotated so that the swaging tool 10 can be used in confined areas. The sliding engagement between the bottom surface 144 of the transfer arms 138 and the outer housing surface 44 and the sliding engagement between the lips 98 and the catches 136 prevent cocking and/or deflection of the movable jaw 22.

The upper sections 164 of the swage adapters 24, 26 can be rotated about their hinged corner 170 to allow the swage fittings 12 into the swaging adapters 24, 26. After the swage fitting 12 is in the swaging adapters 24, 26, the releasable corners 172 can be secured with the latches 180 to prevent the swaging tool 10 from disengaging with the swage fitting 12 during swaging.

Although the present invention has been described in considerable detail with reference to the preferred versions, other versions are possible. Therefore, the spirit and scope of the appended claims should not be limited to the description of the preferred version contained herein.

I claim:

1. A tool for swaging a fitting onto a tube, the fitting having a sleeve for receiving the tube and a collar, the axial movement of the collar over the sleeve causing the collar to apply a radial force to the sleeve and swage the sleeve to the tube, the sleeve and collar each having a contact surface, the tool comprising:

(a) a housing defining a partially enclosed chamber having a longitudinal axis;

(b) a moveable element disposed within the chamber, the moveable element being capable of axial movement along the longitudinal axis between a retracted position and an extended position;

(c) a housing jaw affixed to the housing;

(d) a moveable jaw affixed to the moveable element, the moveable jaw being aligned with the housing jaw so that movement of the moveable element from the retracted position towards the extended position causes the moveable jaw to approach the housing jaw along a fixed axis off-set from the longitudinal axis if the chamber;

(e) a first swaging adapter attached to the housing jaw, the first swaging adapter being sized and dimensioned to accept and restrain the contact surface of the sleeve from axial movement away from the collar; and (f) a second swaging adapter attached to the moveable jaw, the second swaging adapter being sized and dimensioned to accept and restrain the contact surface of the collar from axial movement away from the sleeve;

wherein at least one of the swaging adapters is a locking swaging adapter which substantially encircles a portion of the fitting;

wherein (i) the at least one locking swaging adapter includes an upper and lower section, each section having opposed, substantially parallel sides and (ii) the housing jaw and the movable jaw each include an adapter opening having opposed, substantially parallel walls spaced apart to accept the sides of the upper and lower sections;

wherein (i) each upper section includes a hinged corner hingedly connected to one of the jaws and an opposed releasable corner which pivots about the hinged corner to allow a fitting into the locking swaging adapter, and (ii) the jaw includes a selectively activated latch which, when activated secures the releasable corner to the jaw so that the fitting is retained between the upper and lower sections; and wherein the selectively activated latch has an L-shape and is pivotably attached to the jaw so as to alternatively pivot onto and off of the hinged corner.

2. The tool of claim 1 wherein at least one of the jaws substantially encircles one of the contact surfaces.

3. The tool of claim 1 wherein at least one of the swaging adapters is removably attached to the jaws.

4. The tool of claim 1 wherein (i) the housing jaw alternately accepts both the first swaging adapter and the second swaging adapter and restrains one of them from axial movement; and (ii) the movable jaw alternately accepts both the first swaging adapter and the second swaging adapter and moves the other of them in an axial direction towards the housing jaw upon movement of the movable element from the retracted position towards the extended position.

5. The tool of claim 1 wherein (i) each wall of each adapter opening includes a vertical inset and (ii) each side of the lower section includes a vertical groove which accepts the inset and restrains the lower section from axial movement.

6. The tool of claim 1 wherein, (i) an outer surface of the housing includes at least one lip which extends substantially parallel to the longitudinal axis of the chamber, (ii) for each lip, the movable jaw includes a catch in sliding engagement with that lip, and (iii) the sliding engagement between the lip and the catch holds the movable jaw on the fixed axis and inhibits deflection of the movable jaw.

7. The tool of claim 1 wherein (i) the movable jaw includes at least one transfer arm extending away from a rearward face of the movable jaw, and (ii) each transfer arm including a bottom surface in sliding engagement with an outer surface of the housing, the sliding engagement between the bottom surface and the outer surface inhibiting the deflection of the movable jaw.

8. The tool of claim 1 wherein (i) the first swaging adapter and the second swaging adapter include similarly shaped and sized outer surfaces and (ii) the housing jaw and the movable jaw each include an adapter opening which is sized and shaped to alternately accept and restrain the outer surfaces of the first swaging adapter and the second swaging adapter.

9. The tool of claim 1 wherein the movable element is a piston.

* * * * *